United States Patent [19]

Hirakawa et al.

[11] 4,154,881

[45] May 15, 1979

[54] ANTISTATIC COMPOSITE YARN AND CARPET

[75] Inventors: Tadashi Hirakawa, Kusatsu; Shunzo Mitsui, Kashihara; Junzo Handa, Ohtsu, all of Japan

[73] Assignee: Teijin Limited, Osaka, Japan

[21] Appl. No.: 834,943

[22] Filed: Sep. 20, 1977

[30] Foreign Application Priority Data

| | | | |
|---|---|---|---|
| Sep. 21, 1976 | [JP] | Japan | 126108 |
| Dec. 8, 1976 | [JP] | Japan | 146552 |
| Dec. 8, 1976 | [JP] | Japan | 146553 |

[51] Int. Cl.[2] ..... D03D 27/00

[52] U.S. Cl. ..... 428/92; 57/255; 428/95; 428/97; 428/373

[58] Field of Search ..... 428/92, 95, 96, 97, 428/85, 373; 57/140 BY

[56] References Cited

U.S. PATENT DOCUMENTS

| | | | |
|---|---|---|---|
| 3,475,898 | 11/1969 | Magat | 428/373 |
| 3,582,445 | 6/1971 | Okuhashi | 428/97 |
| 3,678,675 | 7/1972 | Klein | 57/140 BY |

*Primary Examiner*—Marion E. McCamish
*Attorney, Agent, or Firm*—Sughrue, Rothwell, Mion, Zinn and Macpeak

[57] ABSTRACT

An antistatic composite yarn is obtained by wrapping a core yarn with a covering yarn. The core yarn has an electrically conductive coating thereon which comprises a polymeric matrix and a finely divided electrically conductive material therein. The antistatic composite yarn and a pile yarn are used to produce a tufted antistatic carpet.

Polyamide fiber is preferably used as the covering yarn and the pile yarn. The covering yarn contains at least 40% by weight of polyamide fiber, whose content of amino end group is at least $1.0\times10^{-5}$ mol/g higher than that of polyamide fiber contained in the pile yarn.

In the case the pile yarn is composed of at least two kinds of polyamide fibers which differ from one another in the content of amino end group, one of the polyamide fibers has the content of amino end group at least $1.0\times10^{-5}$ mol/g lower than that of another.

8 Claims, 3 Drawing Figures

ANTISTATIC COMPOSITE YARN AND CARPET

BACKGROUND OF THE INVENTION

This invention is concerned with a composite yarn and a carpet tufted thereby, having durable antistatic properties and an excellent appearance.

A carpet, when used especially at low humidity, has an undesirable tendency to build up a static charge in itself as well as the persons who walk thereover, which can cause such electrostatic troubles as shocks to the body and promotion of soiling of the carpet. For the purpose of solving this problem, it has been proposed to incorporate in the surface layer of the carpet an electrically conductive yarn prepared by twisting a pile yarn with a monofilament having an electrically conductive coating thereon (U.S. Pat. No. 3,582,445). However, since the electrically conductive coated filament is partially exposed at surface of the carpet, there occur problems that the coating is liable to be worn away or be separated from the filament by direct contact with the walker in a short time, and that a surface appearance of the carpet is inferior owing to a black or brown coloration of the coating.

Further, it has been proposed to wrap a fine metallic filament with organic and glass fibers (Modern Textile Magazine, May 1966, page 73). However, there arise problems in connection with their blending and processing as well as in the feel or texture of the products obtained, because the textile fibers which are usually used in carpets are essentially dissimilar in character to the metallic fibers.

Furthermore, Japanese Patent Application Laid-open No. 57200/1974 teaches covering a metal-plated fiber with a covering yarn. However, the metal-plated fiber cannot be employed for the carpet, because a metal layer is readily separated from the fiber on use under heavy treading conditions such that the carpet is worn and as the result, antistatic properties of the carpet rapidly deteriorates.

BRIEF SUMMARY OF INVENTION

The present invention relates to an antistatic composite yarn prepared by wrapping a core yarn with a covering yarn, said core yarn having an electrically conductive coating thereon which comprises a polymeric matrix and a finely divided electrically conductive material therein, and an antistatic carpet tufted by said antistatic composite yarn with a pile yarn.

It is an object of the invention to provide an improved durable antistatic composite yarn.

Another object of the invention is to provide an improved durable antistatic carpet.

A further object of the invention is to provide a carpet with an excellent appearance.

Further objects and advantages of the invention will be apparent from the following description, the accompanying drawings, and the appended claims.

DETAILED DESCRIPTION

Figure 1:
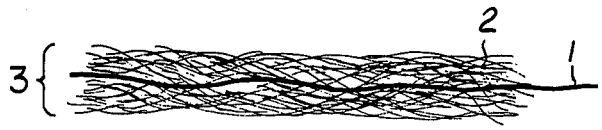
FIG. 1 is a schematic representation of the novel composite yarn of the present invention.
Figure 2:
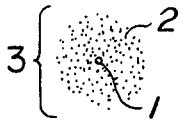
FIG. 2 is a transverse cross section of the yarn of FIG. 1.

Referring now in detail to the drawings, a composite yarn 3 is shown in FIG. 1 and FIG. 2, which yarn includes a core yarn 1 around which a covering yarn 2 is wrapped in a series of helical turns.

The core yarn 1 comprises a substrate of chemical fiber consisting of a polymer such as polyamide, polyester, polyacrylonitrile, polyolefin, cellulose acetate or regenerated cellulose, whereon is formed an electrically conductive coating.

The term "fiber," as used herein and the appended claims, unless otherwise noted, includes staple form as well as continuous filament form. The electrically conductive coating can be formed on the substrate fiber by applying to its surface a polymeric binder solution or emulsion in which is dispersed a finely divided electrically conductive material such as metal or carbon black, as taught in U.S. Pat. No. 3,582,445.

On the other hand, any textile fiber available in staple or filament form may be used as the covering yarn 2. Such fibers include natural or chemical fibers. Particularly, a crimped synthetic filament yarn is preferably used. The crimped filament yarn may be formed by any operation such as texturing, stuffer box crimping, gear crimping, edge crimping, turblent air flow crimping, or any other crimping. Furthermore, fineness of each filament of the crimped yarn is desirable to be less than 5 in denier, preferably less than 3 in denier, to raise the covering ability of the yarn.

The composite yarn 3 is obtained by helically wrapping the core yarn 1 with the covering yarn 2 so as to prevent the exposure of the electrically conductive coating formed on the core yarn 1.

Figure 3:
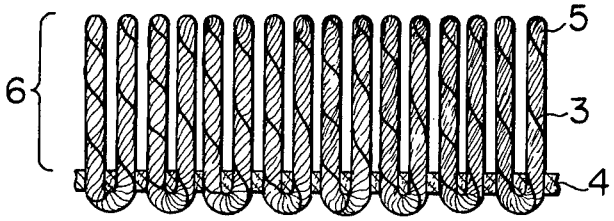
FIG. 3 is an enlarged sectional view of the carpet of the invention.

The composite yarn 3 thus obtained is tufted to a backing 4 with a pile yarn 5 to form a fibrous surface layer 6 of a carpet shown in FIG. 3. The composite yarn 3 is used by twisting with, or by doubling with, or by helically winding around the pile yarn 5.

Usually, polyamide fiber is preferably used as the covering yarn 2 and the pile yarn 5.

In this case, the filaments having a denier per filament of less than 5 are usually used as the covering yarn as described above, whereas a denier per filament of the pile yarn is required to be more than 5 to impart resiliency to the carpet. Owing to the difference of a denier per filament of the both yarns, streaks caused by apparent difference of color shade appears on the surface of the carpet tufted with the above pile yarn and the composite yarn containing the above covering yarn, when dyed, to cause a poor surface appearance of the tufted carpet. This problem is solved by dyeing the covering yarn more deeply than the pile yarn, that is, by using the covering yarn containing at least 40% by weight of polyamide fiber which content of amino end group is at least $1.0\times10^{-5}$ mol/g, preferably at least $1.5\times10^{-5}$ mol/g, higher than that of polyamide fiber contained in the pile yarn.

Moreover, in order to produce the carpet having a multi-color effect, as the pile yarns, are used at least two kinds of polyamide fibers which differ from one another in the content of amino end group, one of which polyamide fibers has the content of amino end group lower than that of another by at least $1.0\times10^{-5}$ mol/g, preferably at least $1.5\times10^{-5}$ mol/g, and each of which polyamide fibers is contained in the pile yarns in an amount of at least 10% by weight. Various kinds of the polyamide fibers may be contained together in the single pile yarn or each of the polyamide fibers may respectively constitute the single pile yarn.

In the latter case, it is preferable that the antistatic composite yarn be contained in the pile yarn whose amino end group content is highest.

The amino end group content is measured by the method that a m-cresol solution of polyamide fiber is titrated with 0.1 N P-toluenesulfonic acid using Thymol Blue as an indicator.

The amino end group content of polyamide fiber is adjusted by adding a diamine such as hexamethylenediamine or xylylenediamine in a polymerization process of polyamide.

The tufted carpet thus obtained may be dyed with ordinary acid dyes, for example, C.I. Acid Orange 10, C.I. Acid Red 37, C.I. Acid Green 25, C.I. Acid Blue 23 and so on, by means of a usual wince dyeing machine, continuous dyeing machine, printing machine, etc. In order to obtain the multi-color effect on the carpet, it is preferable to use together acid dyes and disperse dyes different in hue. As the disperse dyes, C.I. Disperse Yellow 5, C.I. Disperse Red 5, C.I. Disperse Blue 3, etc. may be used.

The pH of the dye bath may be of any value, but the pH range of 4 to 8 is especially preferred, for a uniformly dyed carpet in which streaky uneven dyeing is hardly conspicuous can be obtained. Further, in the pH range of 5 to 8, an antistatic carpet with excellent multicolor dyeing effect can be obtained.

The following examples are given for further illustration of the invention. Voltage of static charge built up on a person shown in the examples is measured according to AATCC Test Method 134-1975 (electrostatic propensity of carpets), Test IV - Scuff Test/leather soles.

EXAMPLE 1

One part of carbon black and 12 parts of chloroprene-phenol type adhesive (toluene solution of polychloroprene/p-t-butyl-phenolformaldehyde resin of solids content 24%) were thoroughly mixed to a paste. A 15-denier nylon 6 monofilament was immersed in the paste and then cured by heating. Thus the monofilament was coated with an electrically conductive coating. The coated monofilament had a diameter of 50 $\mu$m and an electrical resistance of $6\times10^5$ $\Omega$/cm.

The electrically conductive monofilament thus obtained was wrapped in a series of helical turns with 3 plies of 70-denier/24-filament nylon 6 yarns. Similarly, the monofilament was wrapped with 3 plies of 70-denier/24-filament textured nylon 6 yarns (total percentage crimp 20%). Both of the composite yarns thus obtained had improved durable antistatic properties.

EXAMPLE 2

Each of the antistatic composite yarns prepared in Example 1 was helically wound at the number of 35 turns/m on a 2,600-denier/136-filament crimped nylon 6 pile yarn. The pile yarns on which the antistatic composite yarn was wound were tufted to a backing in every six ends of the pile yarns not containing the antistatic composite yarn to form a tufted carpet of 1/10 inches gauge.

Further, using the pile yarn doubled with the composite yarn instead of the pile yarn on which the composite yarn was wound, a tufted carpet was formed in a similar manner as above.

The samples of the carpets thus obtained were submitted to durability test by the trafic exposure for one year (about 70,000 walkers trod thereon). Voltages of static charge built up on a human body during the walk on the samples of the carpets before the use and after the one-year use were measured according to scuff test of AATCC Test Method, and the results obtained were as shown in the following table. It is apparent from the table that antistatic durability of the carpet is remarkably improved by the use of the antistatic composite yarn of the present invention.

| | | Voltage of static charge built up on person (KV) | |
|---|---|---|---|
| Covering yarn | Manner to incorporate composite yarn in carpet | Before use | After one-year use |
| Not used (control) | Pile yarn helically wound with antistatic coated monofilament was tufted. | 1.2 | 4.3 |
| Nylon 6 yarn | Pile yarn helically wound with composite yarn was tufted. | 2.4 | 2.8 |
| Textured nylon 6 yarn | | 2.0 | 2.5 |
| Nylon 6 yarn | Pile yarn doubled with composite yarn was tufted. | 2.8 | 3.1 |
| Textured nylon 6 yarn | | 2.2 | 2.4 |

EXAMPLE 3

The electrically conductive monofilament produced in Example 1 was wrapped with 3 plies of 70-denier/24-filament textured nylon 6 yarns (total percentage crimp 20%) having $5.1\times10^{-5}$, $6.0\times10^{-5}$, $6.2\times10^{-5}$, $6.5\times10^{-5}$, $6.7\times10^{-5}$, or $8.7\times10^{-5}$ mol/g of amino end group to form an antistatic composite yarn.

Each of the antistatic composite yarns was helically wound at the number of 35 turns/m on a 2,600-denier/136-filament crimped nylon 6 pile yarn having $5.1\times10^{-5}$ mol/g of amino end group.

The pile yarns containing the antistatic composite yarn were tufted to a backing with the above pile yarns not containing the antistatic composite yarn in a similar manner to Example 2 to form a tufted carpet.

The carpets thus obtained were dyed with C.I. Acid Green 25 (O.W.f. 1%) under boiling for 1 hour after adjusting the pH of the dye bath by the use of acetic acid.

As to the dyed carpets, streaks caused by apparent difference of color shade was evaluated and voltages of static charge built up on a human body during a walk on the carpets before use and after a one-year use were measured according to scuff test of AATCC Test Method.

The results shown in the following table were obtained. Antistatic durability of the carpet is remarkably improved by the use of the antistatic composite yarn of the present invention. Moreover, when the covering yarn wrapped on the electrically conductive coated monofilament contains at least 40% by weight of polyamide fiber which content of amino end group is at least $1.0\times10^{-5}$ mol/g, preferably at least $1.5\times10^{-5}$ mol/g, higher than that of polyamide fiber contained in the pile yarn, streaks caused by apparent difference of color shade is hardly recognized in the dyed carpets.

| Amino end Group ($\times 10^{-5}$ mol/g | | Occurrence of streak caused by apparent difference of color shade | Voltage of Static Charge built up on person (KV) | |
|---|---|---|---|---|
| Pile Yarn | Covering Yarn | | Before use | After one-year use |
| | not used | Remarkable | 1.8 | 4.3 |
| | 8.7 | Unrecognized | 2.0 | 2.5 |
| | 6.7 | Unrecognized | 2.1 | 2.4 |
| | 6.5 | Scarecely recognized | 2.0 | 2.4 |
| 5.1 | | | | |
| | 6.2 | Scarecely recognized | 2.0 | 2.5 |
| | 6.0 | Extremely remarkable | 1.9 | 2.4 |
| | 5.1 | Extremely remarkable | 2.0 | 2.5 |

EXAMPLE 4

The electrically conductive monofilament prepared in Example 1 was wrapped with 3 plies of 70-denier/24-filament textured nylon 6 yarns (total percentage crimp 20%) to form an antistatic composite yarn.

The antistatic composite yarn was helically wound on a pile yarn which was produced by twisting 2 plies (B and C) or 3 plies (A, B and C) of 1,400-denier/68-filament crimped nylon 6 yarns. Each ply of the nylon 6 yarns was different in the content of amino end group.

The contents of amino end group of the covering yarn and each ply of nylon 6 yarns which compose the pile yarn are shown in the following table.

The pile yarns containing the antistatic composite yarn were tufted to a backing with the above pile yarns not containing the antistatic composite yarn in a similar manner to Example 2 to form a tufted carpet.

The carpets thus obtained were dyed with C.I. Acid Blue 23 (o.w.f. 2%) and C.I. Disperse Yellow 5 (o.w.f. 0.5%) in a wince dyeing machine under boiling for one hour after adjusting the pH of the dye bath to 6.0 by the use of acetic acid.

The results shown in the following table were obtained by evaluating the multi-color dyeing effects, streaks caused by apparent difference of color shade, and voltages of static charge built up on a human body during the walk on the carpets before use and after a one-year use.

As shown in the table, streaks caused by apparent difference of color shade appeared on the surface of the carpets containing the electrically conductive monofilaments not covered with the covering yarn, and the voltages of static charge built up on a person greatly increased due to the wear and the separation of the electrically conductive coating.

The carpet having the difference of less than $1.0\times10^{-5}$ mol/g between the covering yarn and the nylon 6 yarn C contained in the pile yarn in the content of amino end group showed a marked development of streaks caused by apparent difference of color shade. The carpet having the difference of less than $1.0\times10^{-5}$ mol/g between the nylon 6 yarn C and the nylon 6 yarn B or between the yarn C and the nylon 6 yarns A and B in the content of amino end group showed no multi-color dyeing effect. When the difference in the content of amino end group between the nylon 6 yarns A and B, the covering yarn, and the nylon 6 yarn C was at least $1.0\times10^{-5}$ mol/g, preferably at least $1.5\times10^{-5}$ mol/g, both of the multi-color dyeing effects and the surface appearance were found to be excellent.

| Amino end group ($\times 10^{-5}$ mol/g) | | | | Multi Color dyeing effect | Occurrence of streak caused by apparent difference of color shade | Voltage of static charge built up on person (KV) | |
|---|---|---|---|---|---|---|---|
| Yarn A contained in pile yarn | Yarn B contained in pile yarn | Yarn C contained in pile yarn | Covering yarn | | | Before use | After one-year use |
| not used | 5.8 | 5.1 | not used | poor | remarkable | 1.8 | 4.3 |
| " | 6.2 | 5.1 | not used | very Good | remarkable | 1.8 | 4.3 |
| " | 6.2 | 5.1 | 6.0 | very good | extremely remarkable | 2.0 | 2.4 |
| " | 6.7 | 5.1 | 6.0 | excellent | extremely remarkable | 2.0 | 2.5 |
| " | 6.2 | 5.1 | 6.2 | very good | scarecely recognized | 1.9 | 2. |
| " | 6.7 | 5.1 | 6.2 | excellent | scarecely recognized | 2.0 | 2.4 |
| " | 6.2 | 5.1 | 6.7 | very good | unrecognized | 2.0 | 2.3 |
| " | 6.7 | 5.1 | 6.7 | excellent | unrecognized | 2.1 | 2.4 |
| 6.5 | 5.1 | 3.8 | 3.8 | very good | extremely remarkable | 1.9 | 2.5 |
| 6.5 | 5.1 | 3.8 | 5.1 | very good | scarecely recognized | 2.0 | 2.4 |
| 6.5 | 5.1 | 3.8 | 6.5 | very good | unrecognized | 2.1 | 2.4 |

What is claimed is:

1. A composite yarn having durable antistatic properties which comprises a continuous core filament having an electrically conductive coating thereon, said coating comprising a polymeric matrix and a finely divided electrically conductive material therein, and a continuous covering yarn helically wrapping and completely surrounding the core filament.

2. The composite yarn of claim 1 wherein said covering yarn comprises crimped synthetic filaments.

3. The composite yarn of claim 1 wherein said covering yarn is polyamide.

4. A tufted carpet having durable antistatic properties which comprises a backing and a fibrous surface layer comprising tufts which are composed of a composite yarn and a pile yarn, said composite yarn comprising a continuous core filament having an electrically conductive coating thereon, said coating comprising a polymeric matrix and a finely divided electrically conductive material therein, and a continuous covering yarn helically wrapping and completely surrounding the core filament.

5. The tufted carpet of claim 4 wherein said covering yarn comprises crimped synthetic filaments.

6. The tufted carpet of claim 4 wherein each of said covering yarn and said pile yarn is polyamide.

7. The tufted carpet of claim 6 wherein said covering yarn contains at least 40% by weight of polyamide fiber whose content of amino end group is at least $1.0\times10^{-5}$ mol/g higher than that of polyamide fiber contained in said pile yarn.

8. The tufted carpet of claim 7 wherein at least two kinds of polyamide fibers which differ from one another in the content of amino end group are used as said pile yarns, one of said polyamide fibers having the content of amino end group at least $1.0\times10^{-5}$ mol/g lower than that of another, each of said polyamide fibers contained in said pile yarns in an amount of at least 10% by weight.

* * * * *